United States Patent [19]

Berchem et al.

[11] Patent Number: 4,910,093

[45] Date of Patent: Mar. 20, 1990

[54] PISTON BLANK FOR A FORGED PISTON

[75] Inventors: Rütger Berchem, Essen; Volkhard Schnitzler, Bochum; Friedhelm Stahlschmidt, Sprockhövel, all of Fed. Rep. of Germany

[73] Assignee: Berchem & Schaberg GmbH, Gelsenkirchen-Ückendorf, Fed. Rep. of Germany

[21] Appl. No.: 331,469

[22] Filed: Mar. 30, 1989

[30] Foreign Application Priority Data

Apr. 1, 1988 [DE] Fed. Rep. of Germany ..... 3811200

[51] Int. Cl.[4] ..... F02F 3/00; B21K 1/18

[52] U.S. Cl. ..... 428/582; 123/193 P

[58] Field of Search ..... 428/577, 579, 582; 29/156.5 R; 123/193 P

[56] References Cited

U.S. PATENT DOCUMENTS

| | | | |
|---|---|---|---|
| 1,283,021 | 10/1918 | Anderson | 29/156.5 R |
| 1,294,833 | 2/1919 | Ricardo | 29/156.6 R |
| 1,554,157 | 9/1925 | Deans | 29/156.5 R |
| 1,774,106 | 8/1930 | Nelson | 29/156.5 R |
| 1,795,353 | 3/1931 | Taylor et al. | 29/156.5 R |
| 4,334,507 | 6/1982 | Köhnert et al. | 29/156.5 R |
| 4,662,047 | 5/1987 | Berchem | 29/156.5 R |

FOREIGN PATENT DOCUMENTS 3502248 5/1986 Fed. Rep. of Germany .

*Primary Examiner*—John J. Zimmerman
*Attorney, Agent, or Firm*—Herbert Dubno

[57] ABSTRACT

A forged piston blank for a forged piston of an internal combustion engine is formed with undercuts between the eye portions and crown side or head portions of the ears so that a larger piston pin may be accommodated by virtue of the fact that the wall thickness at the upper portion of the eye is greater than the wall thickness of the head portion of the ear.

2 Claims, 1 Drawing Sheet

PISTON BLANK FOR A FORGED PISTON

FIELD OF THE INVENTION

Our present invention relates to a piston blank for a forged piston and, more particularly, to a piston blank of the type in which a pair of elongated ears extend downwardly from the piston crown or head.

BACKGROUND OF THE INVENTION

It is known (see German Patent No. 3502248 and the corresponding U.S. Pat. No. 4,662,047 issued May 5, 1987) to provide a piston blank for a forged piston for an internal combustion engine with a piston head or a piston crown having a heat-throttling or heat-barrier annular gap defined along the inner side of the piston apron or collar which rides along the wall of the cylinder.

On the underside of the piston head or crown, a pair of connecting rod ears extend downwardly and can be considered to have eye portions remote from the piston head or crown and head portions proximal to the latter. In the eye portions, recesses can be formed in the casting and/or during the forging of the blank which can be machined to provide the bores which can accommodate the piston pin by means of which the connecting rod or a rocker arm or other piston rod may be pivotally connected to the piston between the ears.

The piston crown or head itself can comprise a piston cover lying inwardly of the collar or apron, and this collar or apron. On the underside of the cover, the blank can be formed with a rib or web bridging between the ears and constituting a so-called fire rib.

The heat-throttling annular gap is thus located between the piston crown collar and the piston shaft formed by the aforementioned ears and referred to hereinafter on occasion as the piston shaft ears.

In general, the forged piston blank is subjected to machining processes to form the finished forged piston, these machining processes including machining the outer surface of the collar or apron and the forming of the aforementioned bores in the regions constituted by the recesses described. It is desirable, obviously, to so form the piston blank that the machining operations can be held to a minimum.

In the prior art piston blank of this type, described and illustrated in the aforementioned patents, the piston shaft ears have a wall thickness which generally increases monotonically, i.e. continuously, from the lower end of the ear to its junction with the piston cover, i.e. the head of the piston.

While this does satisfy all of the requirements for enabling the ear to withstand the stresses to which it will be subjected both in the thermal and mechanical sense in a wide variety of engines, it does not satisfy the needs of more modern engines with larger cylinder bores and pistons of correspondingly larger diameters.

Indeed, modern developments in engine construction have required larger cylinder bores and pistons which must be subjected to greater stress and, as a consequence, larger diameter piston pins to connect the pistons to the connecting rods. Such larger diameter piston pins are necessary to keep the loading per unit area at a minimum and to be able to take up greater stresses in the connection between the rod and the piston.

As a consequence, the practice used in the past with respect to a continuous taper of the ears from the piston head, when applied to the larger diameter recesses and bores necessary to receive large diameter piston pins have not proved to be satisfactory and problems have been encountered in the ability of the piston to accommodate the high stresses both thermal and mechanical which arise in large diameter cylinders and other modern engines. The problem is all the more pronounced because it requires solving without significant modification of the outer geometry of the piston crown.

OBJECTS OF THE INVENTION

It is the principal object of the present invention to provide an improved forged piston blank for the production of a forged piston for an internal combustion engine whereby the drawbacks of the prior art piston describe and above can be obviated.

Another object of our invention is to provide an improved piston blank which can be used with the larger diameter piston pins found to be desirable in more modern internal combustion engines without problems.

SUMMARY OF THE INVENTION

These objects and others which will become apparent hereinafter are attained, in accordance with the invention, by providing the eye portion of each ear so that it is of a greater thickness in an upper region thereof, adjoining the upper portion of the respective recess, than the wall thickness of the crown-side or head portion of the ear and by providing the crown-side or head portion of the ear with an undercut at its junction with the eye portion of the ear.

More specifically, the piston blank of the invention can comprise:

- a piston head;
- an annular piston skirt extending downwardly from the piston head and defining inwardly of the piston skirt an annular heat-throttling gap;
- a pair of elongated ears extending downwardly from the piston head inwardly of the gap and each formed with an eye portion remote from the head and a head portion proximal to the head;
- a respective recess formed in each of the eye portion and adapted to be machined into a bore for receiving a piston pin adapted to pivotally couple the piston with a connecting rod, the eye portions each having a wall thickness at an upper portion thereof adjacent an upper part of the respective recess which is greater than the wall thickness of the respective head portion at least over a major proportion of the length thereof; and
- a respective undercut formed in each of the ears at a junction between the respective eye portion and the respective head portion.

With the piston blank of the invention, the ears are modified with practically no significant change of the geometry of the blank otherwise but such that the finished piston can withstand all of the stresses which are associated with the higher requirements of modern engine designs. The finishing steps are likewise simple and the forging of the blank can utilize conventional multipartite forging dies which, of course, can be designed to form the undercuts during the forging step without problems. Of course, it is also possible to form the undercut in part during the initial casting operation or, when powder metallurgy is used to fabricate the blank, during the compaction of the powder and during or prior to sintering.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
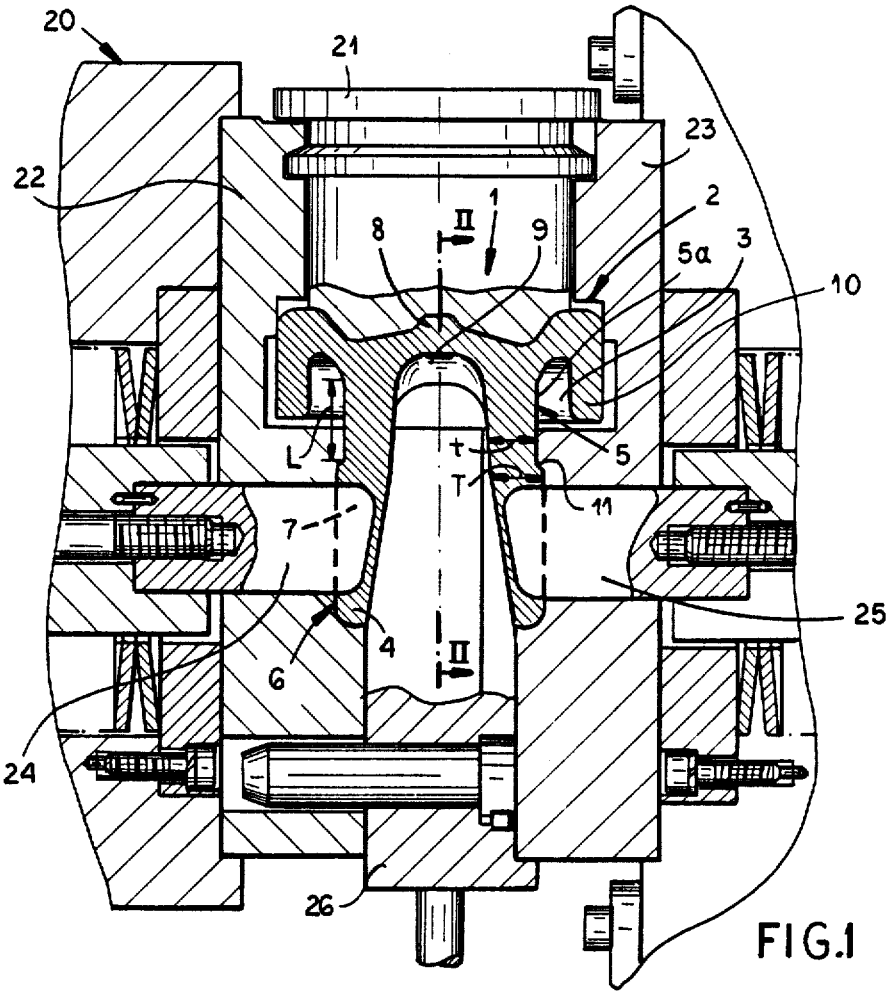
FIG. 1 is an axial cross section through a piston blank illustrating the multipartite forging tool or die in which it can be fabricated.
Figure 2:
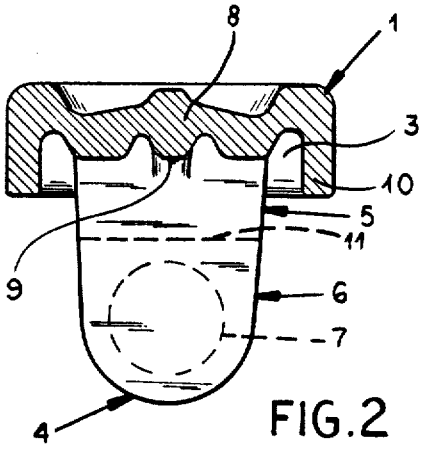
FIG. 2 is a section taken along the line II—II of FIG. 1 but illustrating only the forged blank.

The forged blank 1 shown in the drawing is used for the fabrication of a forged piston for an internal combustion engine and can be machined in the manner previously described.

The basic construction of the blank 1 includes a piston crown or head 2 with an annular heat-throttling gap 3 and a piston shaft formed by two elongated ears 4.

The ears 4 each have a crown-side or head portion 5 and an eye portion 6.

In the eye portion 6 are formed recesses 7 which can be machined into bores to receive the usual piston pin which has not been illustrated and which serves to pivotally connect the piston to a connecting rod disposed between the ears.

The piston head or crown 2 comprises, in turn, a piston cover or disk 8, on the underside of which a fire rib 9 is provided and has an upper surface contoured and dimensioned with respect to the usual aerodynamic and thermal stress considerations.

The head or crown also comprises a piston crown collar or apron 10 which extends downwardly from the head. Between the apron 10 and the piston shaft, the aforementioned annular heat-throttling gap 3 is provided.

According to the invention, at the upper region of the eye portion 6 and at the top of the recesses 7, the eye portion has a greater wall thickness T than the wall thickness t which applies over at least the larger portion of the length of the crown side part or head portion 5. This larger portion of the crown side part is the length L thereof over which the outer surfaces 5*a* of the head portions 5 have a constant spacing from one another.

The crown side part or head portion 5 is separated from the eye portion 6 by an undercut 11 of each ear. As a consequence, relatively large diameter bores can be formed at the recesses 7 to accommodate large diameter piston pins with improved low distribution and thus reduced stress even under increased loading of the piston.

As can be seen from FIG. 1, moreover, the die 20 in which the piston is forged can have a one-piece head former 21 which is received between the two parts 22 and 23 which can adjoin one another to define the shape of the eyes and the apron. A pair of rams 24 and 25 can project both the die parts 22 and 23 to form the recesses 7 and the inner portion of the ears can be formed by a die tongue 26 extending between the ears.

The mechanisms for displacing the die parts are conventional in the art and have not been illustrated.

We claim:

1. A one-piece metal piston blank for a forged piston for an internal combustion engine, comprising:

a piston head;

an annular piston skirt extending downwardly from said piston head and defining inwardly of said piston skirt an annular heat-throttling gap;

a pair of elongated ears extending downwardly from said piston head inwardly of said gap and each formed with an eye portion remote from said head and a head portion proximal to said head;

a respective recess formed in each of said eye portions and adapted to be machined into a bore for receiving a piston pin adapted to pivotally couple the piston with a connecting rod, said eye portions each having a wall thickness at an upper portion thereof adjacent an upper part of the respective recess which is greater than the wall thickness of the respective head portion at least over a major proportion of the length thereof, wherein said head portions have a constant spacing between outer surfaces thereof over said major proportion of the lengths of said head portions; and a respective undercut formed in each of said ears at a junction between the respective eye portion and the respective head portion, each of said undercuts being formed in an outer surface of the respective ear, the wall thicknesses of said eye portions tapering away from said undercuts to free ends of said eye portions.

2. The piston blank defined in claim 1, further comprising a fire rib bridging said ears at said head.

* * * * *